US008102637B2

(12) United States Patent
Hunt et al.

(10) Patent No.: US 8,102,637 B2
(45) Date of Patent: Jan. 24, 2012

(54) CONTROL TECHNIQUES FOR ELECTROSTATIC MICROELECTROMECHANICAL (MEM) STRUCTURE

(75) Inventors: William Hunt, Limerick (IE); Denis Ellis, Limerick (IE); Padraig Fitzgerald, Co. Cork (IE); Colin Lyden, Baltimore (IE)

(73) Assignee: Analog Devices, Inc., Norwood, MA (US)

( * ) Notice: Subject to any disclaimer, the term of this patent is extended or adjusted under 35 U.S.C. 154(b) by 107 days.

(21) Appl. No.: 12/507,361

(22) Filed: Jul. 22, 2009

(65) Prior Publication Data

US 2011/0019330 A1 Jan. 27, 2011

(51) Int. Cl.
*H01H 47/00* (2006.01)

(52) U.S. Cl. ..... 361/211; 361/207

(58) Field of Classification Search ..... 361/207, 361/278

See application file for complete search history.

(56) References Cited

U.S. PATENT DOCUMENTS

| | | | | |
|---|---|---|---|---|
| 5,455,723 | A | 10/1995 | Boutaghou et al. | |
| 5,880,565 | A | 3/1999 | Watanabe | |
| 6,396,368 | B1 | 5/2002 | Chow et al. | |
| 6,525,446 | B1 * | 2/2003 | Yasuda et al. | 310/309 |
| 6,577,975 | B2 | 6/2003 | Chiesa | |
| 6,710,507 | B2 * | 3/2004 | Murphy | 310/309 |
| 6,847,908 | B2 | 1/2005 | Chawla | |
| 7,178,397 | B2 * | 2/2007 | Lee et al. | 73/504.12 |
| 7,719,162 | B2 * | 5/2010 | Min et al. | 310/309 |
| 2003/0127698 | A1 | 7/2003 | Lee | |
| 2003/0133252 | A1 | 7/2003 | Fasen | |
| 2004/0008097 | A1 | 1/2004 | Ma et al. | |
| 2006/0006883 | A1 | 1/2006 | Foote | |
| 2006/0115920 | A1 * | 6/2006 | Urano et al. | 438/50 |
| 2007/0067127 | A1 | 3/2007 | Bolz | |
| 2008/0151464 | A1 | 6/2008 | Ellis et al. | |

* cited by examiner

*Primary Examiner* — Danny Nguyen
(74) *Attorney, Agent, or Firm* — Kenyon & Kenyon LLP

(57) ABSTRACT

Disclosed are a method, device, and system for a microelectromechanical (MEM) device control system that can control the operation of a MEM device. The system can include a microelectromechanical device and a control circuit. The micromechanical device can include a moveable member coupled to an electrical terminal, a sensor, responsive to a movement of the moveable member, can output a sensor signal based on the movement of the moveable member, and an actuating electrode for receiving a control signal. The control circuit can be responsive to the signals output by the sensor and outputs the control signal to the actuating electrode.

20 Claims, 10 Drawing Sheets

CONTROL TECHNIQUES FOR ELECTROSTATIC MICROELECTROMECHANICAL (MEM) STRUCTURE

BACKGROUND

Embodiments of the present invention are directed to an electrostatically controlled microelectromechanical (MEM) structure. More specifically, the exemplary embodiments are directed to the control of the signal that actuates a component of the MEM structure by detecting a condition of the MEM structure as it operates.

MEM structures can come in various configurations that are suitable for use as switching devices or circuit components, such as a capacitive device.

Actuation of the MEM switch or operation as a MEM circuit component may be influenced by a control signal applied to a terminal and a beam terminal of the MEM device. The applied control signal, e.g., a "set" voltage, generates an electric field that produces an electrostatic force that causes the beam to move toward the terminal. This is similar to the concept of electrostatic force between two parallel plates. When the set voltage is applied to the terminal, the electrostatic force acting on the beam increases as the beam moves through the electric field, and closer to the terminal.

FIG. 1 illustrates the concept of electrostatic force generated by an electric field. The electrostatic force F between two parallel plates 10, 12 separated by a gap with a voltage V applied across them is given by the force equation:

$$F=Q^2\div(2\times\epsilon\times A) \quad \text{(Eq. 1)}$$

where Q is charge, $\epsilon$ is permittivity and A is the area of the plates. This electrostatic force F opposes the mechanical force of a spring S, which is trying to pull the plates apart. When the voltage V between the plates increases (V rises), the charge Q on the plates (10, 12) increases. The increase in charge Q (− and +) causes an increase of the electrostatic force F. The increased force F causes the plates (10, 12) to move closer together closing the gap, and, as a result, the capacitance C increases. If the capacitance C increases, the charge Q must increase because of the relationship Q=C×V. If the charge Q increases, the force F increases causing the gap between the plates to continue to close, and further increasing the capacitance C. This is a positive feedback loop, and when the gap is closed by, for example, ⅓, this feedback loop can become uncontrollable, and the force F increases exponentially and the top plate can collapse onto the bottom plate due to the force F.

Capacitance is also determined by the distance or, the size of the gap, between the plates (10, 12). As shown in Eq. 2, as the distance between plates of a capacitor increases, the capacitance between those plates decreases. (Eq. 2)

$$C=\frac{\varepsilon A}{d}$$

Where

C=Capacitance in Farads $\epsilon$=Permittivity of dielectric (absolute, not relative)

A=Area of plate overlap in square meters d=Distance between plates in meters

A factor during this "pull-in" effect is that the charge Q was not controllable when driven by the set voltage V. When the plates begin to close together, charge Q rushes onto the plates increasing the electrostatic force F, which can increase the closing force in a MEMs device switch. If the charge Q can be controlled, the positive feedback loop can be broken.

Accordingly, there is a need for a variable voltage to maintain better control of the charge to minimize or eliminate the "pull-in" effects of the feedback loop, and to allow the beam of the MEM device to "land" more softly, or more accurately control the movement of the beam(s) when the MEM device is actuated.

DETAILED DESCRIPTION

Embodiments of the present invention provide a microelectromechanical (MEM) structure control system. The system may include a microelectromechanical structure and a control circuit. The micromechanical structure may include a moveable member coupled to an electrical terminal, a sensor that is responsive to a movement of the moveable member and outputs a sensor signal based on the movement of the moveable member, and an actuating electrode for receiving a control signal. The control circuit is responsive to the signals output by the sensor and outputs the control signal to the actuating electrode.

Embodiments of the present invention provide a method for controlling a MEM device by detecting a movement of a beam structure of a MEM device at a detector on the MEM device. Based on the detected movement of the beam structure, a signal is output. The output signal is used in sensor circuitry to generate a drive signal. The drive signal is applied to a gate electrode of the MEM device.

Another embodiment of the present invention provides a system for controlling a MEM device. The system comprises a sensor, a processor, a drive circuit and a controller. The sensor is connected to the MEM device and detects signals output from the MEM device. The signals output from the MEM device indicate a movement of the MEM device. The processor processes signals received by the sensing circuitry. The drive circuit receives signals from the processor, and converts the received signals to a drive signal that actuates the MEM device. The controller controls the processor and indicates to the processor which signals are to be output to the drive circuit.

Figure 1:
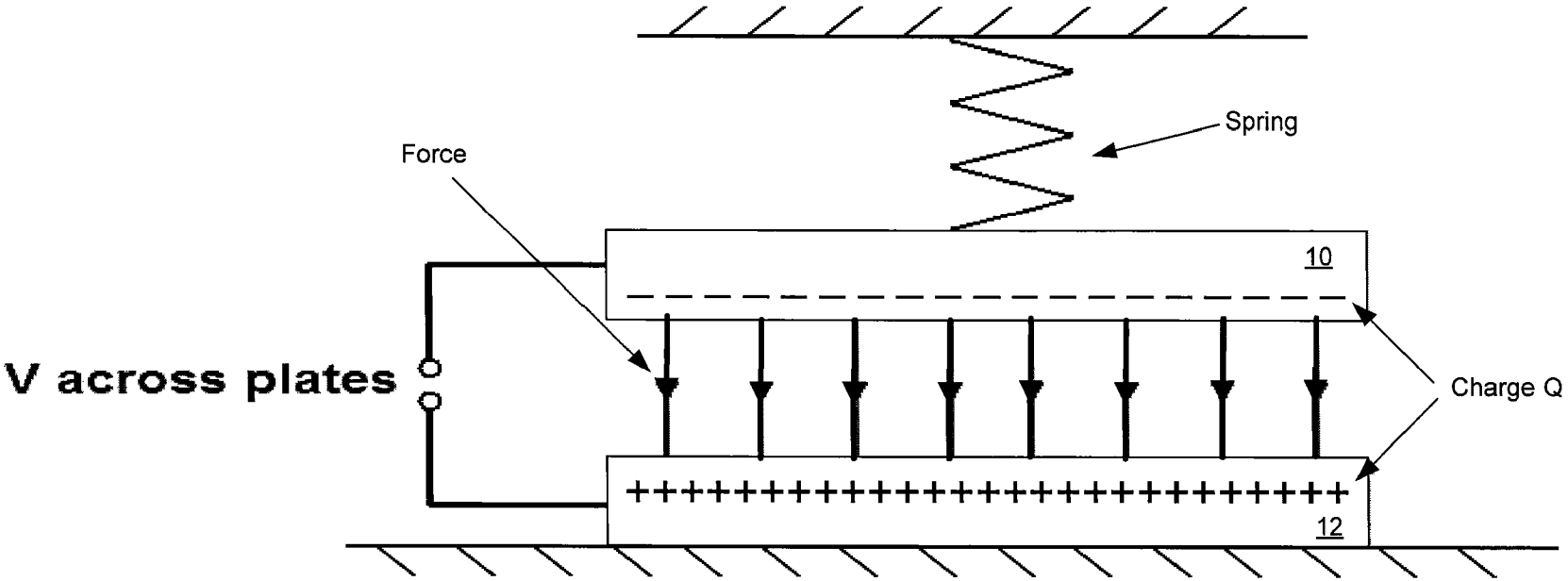
FIG. 1 illustrates the concept of force generated by an electric field.
Figure 2A:
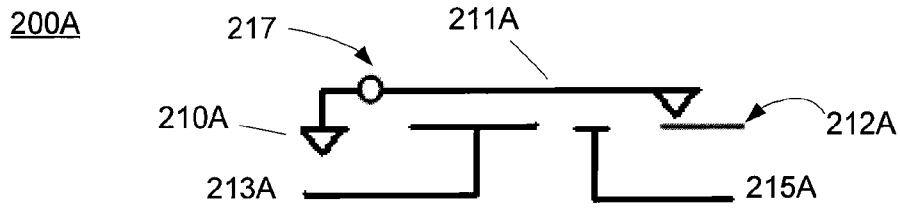
FIGS. 2A, 2B and 2C illustrate exemplary configurations of a MEM cantilever switch with capacitive sensing, a MEM cantilever switch with see-saw capacitive sensing, and a MEM fixed-fixed switch with capacitive sensing, respectively.
Figure 2B:
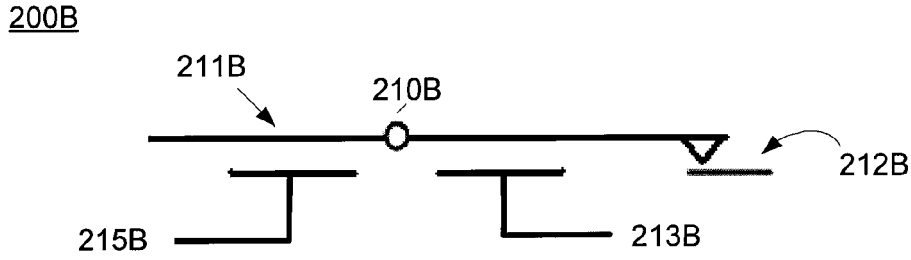
Figure 2C:
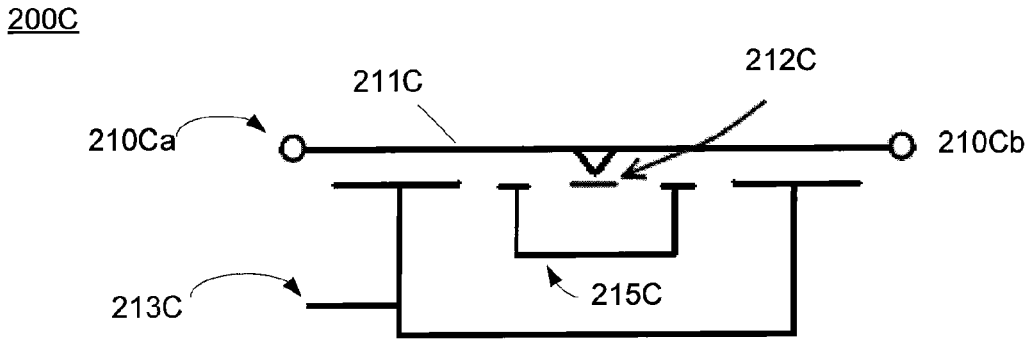

FIGS. 2A, 2B and 2C illustrate exemplary configurations of a MEM cantilever switch with capacitive sensing, a MEM cantilever switch with see-saw capacitive sensing, and a MEM fixed-fixed switch with capacitive sensing, respectively.

FIG. 2A illustrates a MEM cantilever switch 200A with capacitive sensing according to an embodiment of the present invention. The MEM cantilever switch 200A, when actuated, opens and closes a circuit path between device input and device output terminals, such as source 210A and drain 212A. The switch 200A is actuated based on a voltage applied to a gate 213A. The illustrated beam 211A pivots approximately about the point 217, which is in the same general area as the source 210A that leads to a connection terminal. The beam 211A moves upwards and downwards to either open or close the switch. In the open position, the beam 211A is extended up and away from the drain 212A, and in the closed position, the tip of the beam 211A is in contact with the drain 212A. In this configuration, the source 210A can remain stationary and only the beam 211A moves about pivot point 217. The up and down movement of the beam 211A influences the voltage detected by capacitive detector 215A, which results from the change in capacitance between the beam 211A and the capacitive detector 215A as the beam 211A moves. Based on the voltage detected by the capacitive detector 215A, a control circuit can control the voltage applied to gate 213A.

FIG. 2B illustrates a MEM cantilever switch 200B with see-saw sensing according to an embodiment of the present invention. The MEM cantilever switch 200*b*, when actuated opens or closes a circuit path between device input and device output terminals, such as source 210B and drain 212B. The switch 200B is actuated based on a voltage applied to gate 213B. The source 210B can act as a pivot point around which the beam 211B pivots and a part of the circuit path between the source 210B and the drain 212B. The movement of the beam 211B influences the voltage detected by capacitive detector 215B, which results from the change in capacitance between the beam 211B and the capacitive detector 215B as the beam 211B moves. Due to the location of the capacitive detector 215B, the detected voltage is inversely proportional to movement of the beam 211B. In other words, as the gap between the beam 211B and the cap sense 215B increases, the switch 200C is moves closer to closing. Based on the voltage detected by the capacitive detector 215B, a control circuit according to an embodiment of the present invention can control the voltage applied to gate 213B.

FIG. 2C illustrates a MEM fixed-fixed switch 200C with capacitive sensing according to an embodiment of the present invention. The MEM fixed-fixed switch 200C, when actuated, opens and closes a circuit path between device input and device output terminals, such as either one of or both source 210Ca or 210Cb connections and drain connection 212C. As shown, the beam 211 can pivot at source 210C, which also can act as a pivot point. The switch 200C is actuated based on a voltage applied to gate 213C. With a voltage present at gate 213C, the switch 200C closes by movement, or flexing, of the beam 211C downward at the drain 212C. If a signal is present at either or both of source connections, 210Ca, 210Cb, the signal is passed to drain 212C. The movement of the beam 211C influences the voltage detected by capacitive detector 215C, which results from the change in capacitance between the beam 211C and the capacitive detector 215C as the beam 211C moves. Based on the voltage detected by the capacitive detector 215C, a control circuit according to an embodiment of the present invention can control the voltage applied to gate 213C. The control circuit will be described below in more detail.

Figure 3A:
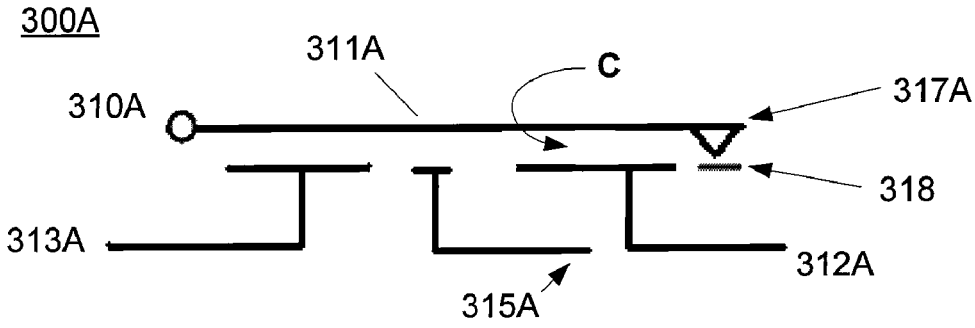
FIGS. 3A and 3B illustrate exemplary configurations of a MEM cantilever bi-state capacitor and a MEM cantilever fully variable capacitor, respectively.
Figure 3B:
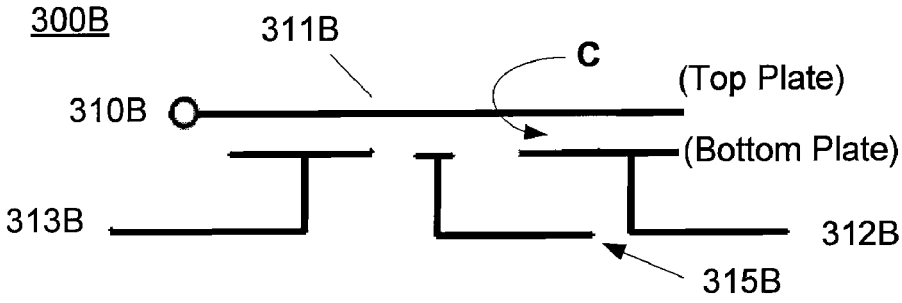

FIGS. 3A and 3B illustrate exemplary configurations of a MEM cantilever bi-state capacitor and a MEM cantilever fully variable capacitor, respectively. The MEM capacitor devices of FIGS. 3A and 3B provide a capacitive device in a circuit. The capacitive MEM device 300A comprises device input/output (I/O) terminals 310A and 312A, a gate 313A, a capacitance detector 315A, a tip 317 and a stop 318. The capacitive device 300A is a two-state device that provides a first capacitance value or a second capacitance value depending upon whether the device 300A is actuated. The capacitance C is between I/O terminals 310A and 312A. The beam 311A can pivot, up or down, about a point that can be at approximately the same location as terminal 310A. The device 300A can have a first state in which the tip 317 is not in contact with the stop as shown in FIG. 3A, and a second state (not shown) in which tip 317 contacts stop 318. The device 300A is actuated by a voltage applied to gate 313A and the I/O terminal 310A. The applied voltage causes beam 311A to move toward stop 318. In a first state, i.e., when a voltage is not applied to gate 313A and the beam 311A is in a first state as shown in FIG. 3A, the capacitance can be a first value, for example, approximately 50-100 fF, because the distance between the beam and I/O terminal 312A is large. In a second state, i.e., when a voltage is applied to gate 313A and the beam 311A moves to a point where the tip 317 is stopped by stop 318, the capacitance is a second value, such as 200-300 fF. A change in current caused by the moving beam 311A is detected by capacitive detector 315A, which is provided to a control circuit that controls the voltage applied to gate 313A and I/O terminal 310A.

Similarly, the fully variable capacitor 300B illustrated in FIG. 3B operates in substantially the same manner as the bi-state capacitive device 300A except that it can provide a fully variable capacitance between a first capacitance value and a second capacitance value. The capacitive device 300B can have an I/O terminal 310B that is substantially located at a pivot point for beam 311B. A capacitance C is present between I/O terminal 310B and I/O terminal 312B, and can vary as the beam 311B pivots up and down about terminal 310B. In response to a voltage applied to gate 313B, the beam 311B can move downward by pivoting about I/O terminal 310B toward I/O terminal 312B. Removal of the voltage at gate 313B can allow the beam to return to an initial or first position The first capacitance C value is present between the I/O terminal 310B and I/O terminal 312B when the beam 311B is at a first position, and a second capacitance C value when the beam 311B is at a second position. Based on a voltage detected by capacitive detector 315B, the movement of beam 311B is controllable such that any capacitance value between the first capacitance value provided when the beam is at the first position and the second capacitance value provided when the beam is at the second position, i.e., fully variable.

Figure 4:
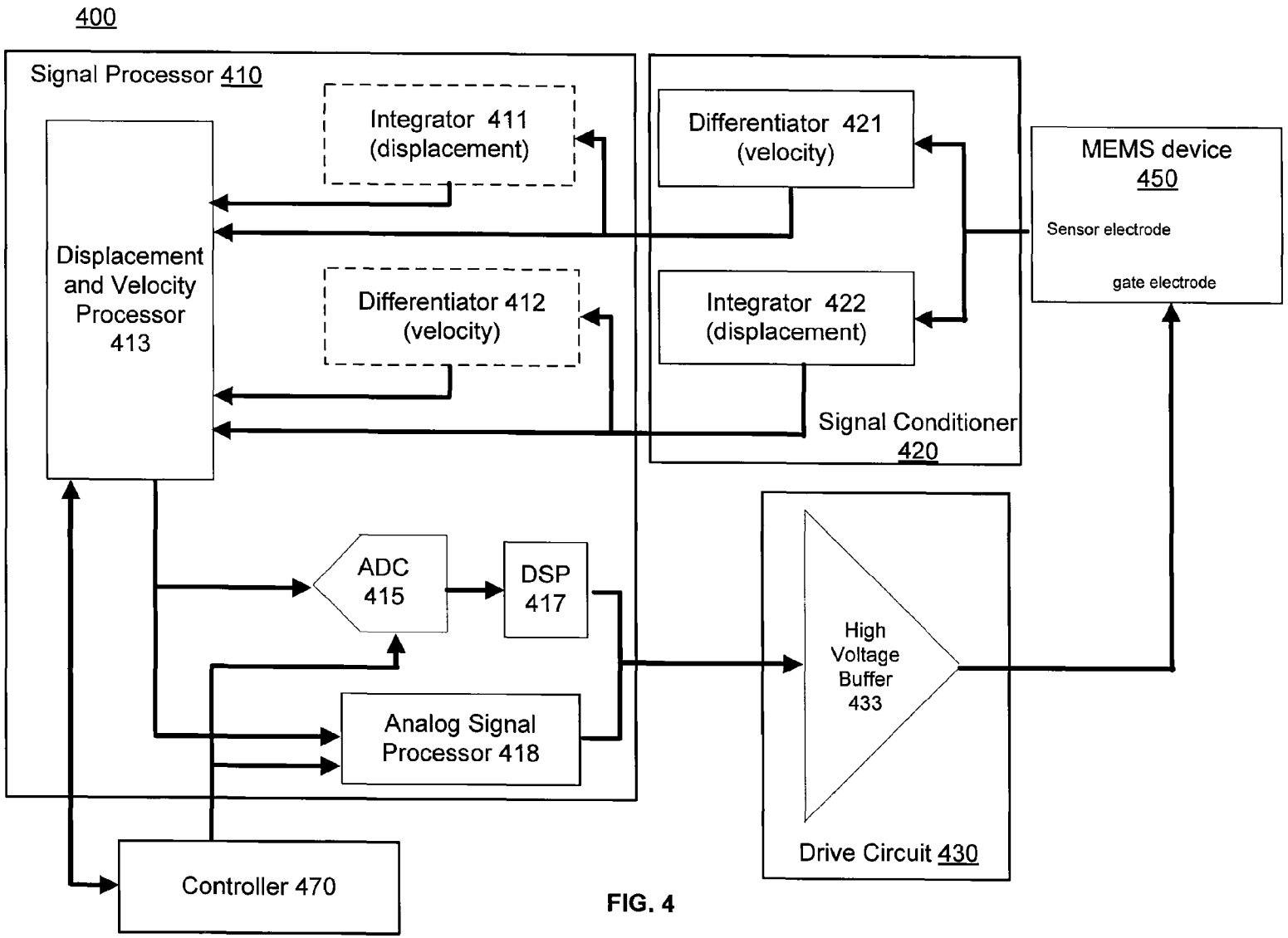
FIG. 4 is a block diagram of an exemplary system for controlling a MEM device according to an exemplary embodiment of the present invention.

In either the switch configuration or the capacitor configuration, processing of the signal output by the capacitive detector can be used to control the voltage applied to the gate. FIG. 4 is a block diagram of an exemplary system for controlling a MEM device according to an embodiment of the present invention.

Depending on the type of MEM switch or MEM capacitance device being driven, the displacement of the beam, i.e., the distance the beam moves from point A to point B, can be monitored, or the velocity of the beam, i.e., the speed at which the beam is moving, can be determined based on signals output from the capacitive detector. The displacement of the beam can be used to determine the drive signal for both the cantilever or fixed switches and both the analog, or fully variable capacitor, and two-state capacitor. The velocity of the beam can be used to determine the drive signal for both the cantilever and fixed switches and the two-state capacitor. Detecting the condition of the beam in the MEM device, and controlling the operation of the MEM switch or MEM capacitance device can be performed by circuit components configured as a system.

An exemplary system 400 can include a signal processor 410, a signal conditioner 420, a drive circuit 430, a controller 470 and a MEM device 450. The signal processor 410 receives inputs from the signal conditioner 420, and, optionally, from controller 470. Signal conditioner 420 outputs a signal representative of the detected movement, i.e., displacement or velocity, of the beam of MEM device 450. The signal processor 410 outputs a signal, such as 1.0-5.0 volts or other suitable voltage, to the drive circuit 430 representing a signal value that can be applied to a gate electrode of the MEM device 450. The drive circuit 430 amplifies the signal output from the signal processor 410 to a voltage, such as 80 volts, that will cause the MEM device 450 to actuate, or otherwise react.

The signal conditioner 420 may be connected to the MEM device 450, and detects signals output from the MEM device 450. The signals output from the MEM device 450 indicate a condition, such as displacement of a beam or the velocity of a moving beam, of the MEM device 450. The signal conditioner 420 can comprise a differentiator circuit 421 for detected the velocity of a beam in the MEM device 450, and an integrator circuit 422 for detecting the displacement of the beam in MEM device 450. Of course, in an alternative configuration, the signal conditioner 420 can have one of either the differentiator circuit 421 or the integrator circuit 422. The differentiator circuit 421 reacts to a change in current output from the MEM device 450 as the beam moves. The current output from the MEM device 450 is representative of the velocity of the moving beam. Similarly, the integrator circuit 422 reacts to a change in voltage caused by the displacement of the beam. The voltage is representative of the displacement of the beam in MEM device 450.

Optionally, the signal processor 410 may include an integrator circuitry 411 and an optional differentiator circuitry 412, and may include a processor, that receive signals output from the signal conditioner 420, and displacement and velocity processor 413. The integrator circuit 411 can produce a signal indicating the displacement of a beam in MEM device 450 based on a signal output from the signal conditioner 420, and the differentiator circuit 412 can produce a signal indicating the velocity of a beam in MEM device 450 based on a signal output from the signal conditioner 420. The outputs from optional integrator circuit 411 and optional differentiator circuit 412 can be input directly into a displacement and velocity processor 413 that uses the inputted signals in algorithms that determine the displacement and/or the velocity of a beam in MEM device 450.

The displacement and velocity processor 413 can, using known integration or differentiation algorithms, determine both displacement and velocity based on the signal inputs. The displacement and velocity processor 413 can have outputs to a controller 470, and outputs to either to signal processing components analog-to-digital converter (ADC) 415 and digital signal processor (DSP) 417 in a first signal path, or analog signal processor 418 in a second signal path, or both. The output signal from the displacement and velocity processor 413 to the controller 470 may indicate to the controller 470 whether the controller should turn on the ADC 415 and DSP 417 in the first signal path or should turn on the analog signal processor 418 in the second signal path. Whether the first signal path comprising ADC 415 and DSP 417 or the second signal path comprising the analog signal processor 418 is used can be based on a control signal output from controller 470.

Alternatively, signals output from the signal conditioner 420 may be input into either the optional integrator 411 or the optional differentiator 412 of the signal processor 410. In this embodiment, the output of the differentiator 421 in signal conditioner 420 is input to the optional integrator 411, which outputs a voltage signal to the displacement and velocity processor 413. Or, if the velocity of the beam in MEM device 450 is being detected by the integrator 422 in signal conditioner 420, its output signal may be input to the optional differentiator 412, which outputs a current signal to the displacement and velocity processor 413. Use of the optional differentiator 412 and the optional integrator 412 can be based on design decisions, user inputs, or control signals from controller 470.

The drive circuit 430 can comprise a high gain, high voltage amplifier 433 that takes the small-scale signal, or digital signal, output by the signal processor 410, and amplifies it to a voltage suitable for actuating the MEM device 450.

The MEM device 450 can be similar to those described with respect to FIGS. 2A-2C, 3A and 3B. The signals output by the drive circuit 430 are applied to the gate electrode in the MEM device 450. In response to a change in condition of the MEM device 450, such as the displacement, or movement, or velocity of a beam (such as beams 211A-C, 311A or 311B as shown in FIGS. 2 and 3, respectively), a signal is output on the sense electrode of the MEM device 450 that is input to the signal conditioner 420.

The controller 470 can be a processor, either external or internal to the system 400 that provides signals to control the signal processor 410. The controller 470 may provide a drive signal to signal the drive circuit 430 to actuate the MEM device 450 as well as reference signals useable by the displacement and velocity processor 413. The controller 470 can output the control and reference signals based upon user input, design decisions, such as the type of drive circuit 430 that is being used to drive the MEM device 450, and/or other considerations. The controller 470 can be used to set parameters such as closing velocity and position of a MEMS device.

Figure 5:
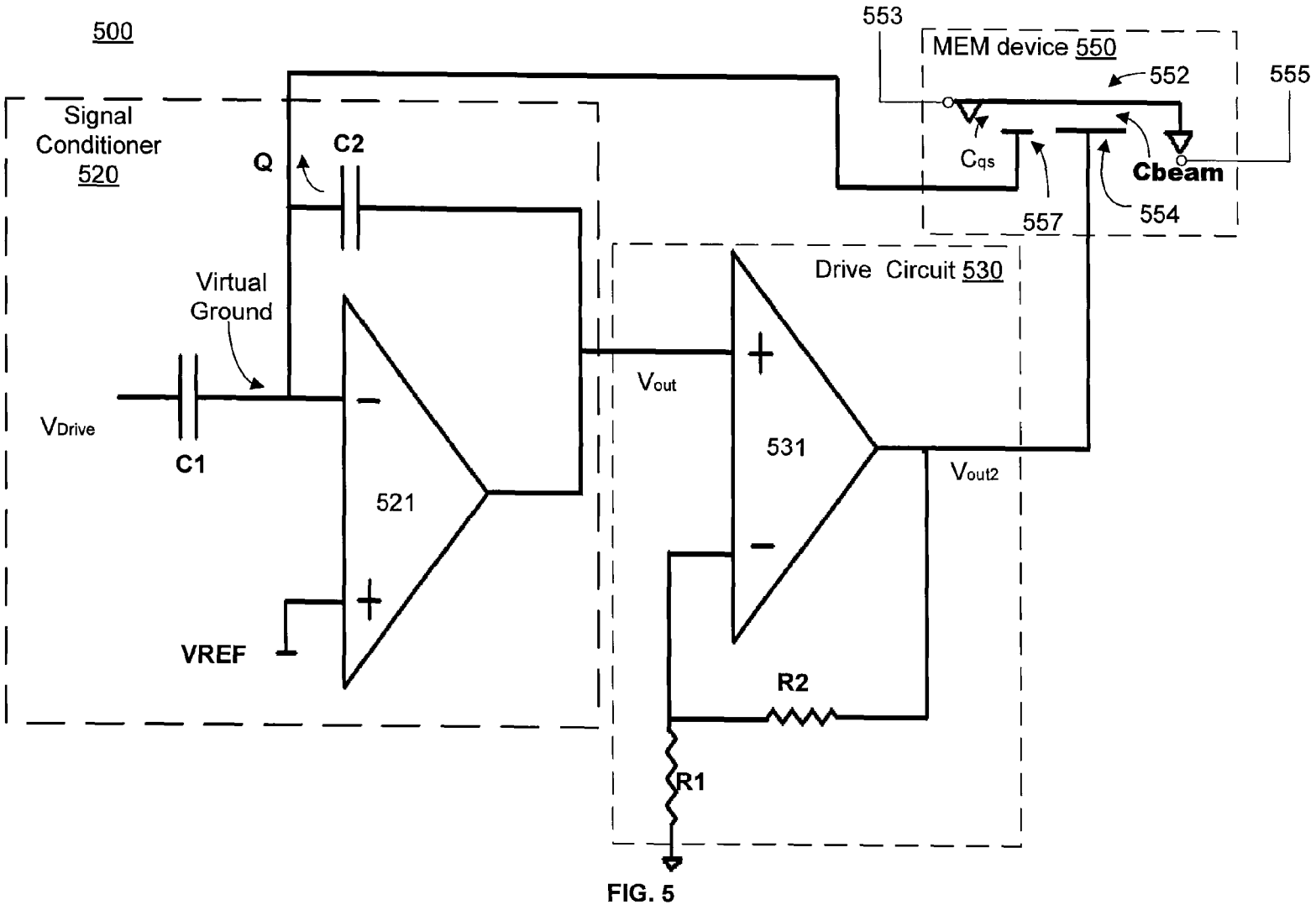
FIG. 5 provides an exemplary implementation of a MEM control circuit according to an embodiment of the present invention.
Figure 6:
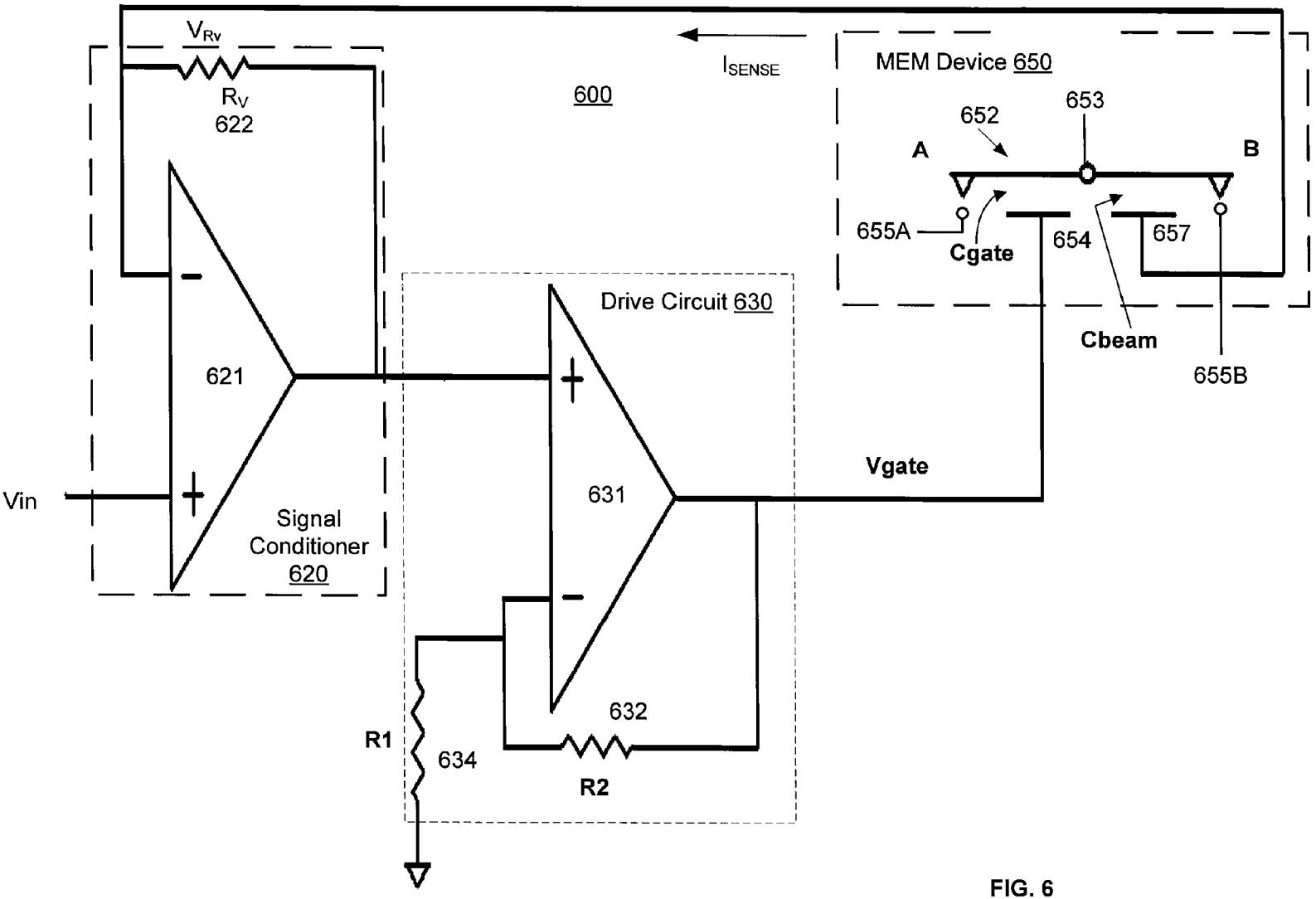
FIG. 6 provides an exemplary implementation of a MEM control circuit according to another embodiment of the present invention.

Exemplary embodiments of signal conditioner 420 will be discussed with reference to FIGS. 5 and 6. FIGS. 5 and 6 illustrate exemplary system implementations that may be used to determine displacement and velocity, respectively, of a beam in a MEM device during operation of the MEM device.

The exemplary system 500 may include a signal conditioner 520, a drive circuit 530, and a MEM device 550. The MEM device 550 comprises a first terminal 553, a second terminal 555, a beam 552, a gate electrode 554 and a sense electrode 557. The MEM device 550 can either be a MEM switch as described above with respect to FIGS. 2A-2C, a capacitor as shown in FIG. 3A or 3B. In either configuration, a circuit path is formed between the first terminal 553 and the second terminal 555. The gate electrode 554 of the MEM device 550 is connected to an output of the drive circuit 530, and the output of the sense electrode is connected to an input of the signal conditioner 520. The drive circuit 530 has inputs, an output and an amplifier. The exemplary drive circuit of FIG. 5 has an operational amplifier 531 with an inverting input and a non-inverting input. The non-inverting input is connected to an output of the signal conditioner 520. Connected to the inverting input of the operational amplifier 531 are a resistor R1 and a feedback resistor R2. A first terminal of the resistor R1 is connected to ground. A second terminal of the feedback resistor R2 is connected to the output of the operational amplifier 531. Of course, more or less inputs may be included that supply power for amplifiers and other circuit components in the drive circuit 530.

When configured as an integrator, the signal conditioner 520 may include three inputs, an output, a first capacitor C1, a second capacitor C2, which is a feedback capacitor, and an operational amplifier 521. The three inputs are: a first input to receive a signal output from the sensing electrode 557 of the MEM device 550, a second input to receive a drive voltage Vdrive, and a third input for receiving a reference voltage VREF. Of course, more or less inputs and outputs may be included, for example, to supply power for amplifiers and other circuit components in the signal conditioner 520. The first input is connected to a first terminal the feedback capacitor C2 and to an inverting input of the operational amplifier 521. The inverting input of the operational amplifier 521 is maintained as a virtual ground. A signal source (not shown) provides a drive voltage Vdrive on the second input of the signal conditioner 520 to a first terminal of capacitor C1. A second terminal of capacitor C1 is connected to the inverting input of operational amplifier 521. A non-inverting input of the operational amplifier 521 is connected to a reference voltage VREF source. An output of the operational amplifier 521, which is also the output of the signal conditioner 520, can be connected to an input of the drive circuit 530. Also connected to the output of the operational amplifier 521 is the second terminal of the feedback capacitor C2.

The displacement of the beam can be an amount of movement of the beam from a first position to a second position, or, in the case of multiple positions, any intermediate positions or a final position, where the amount of movement changes an electrical value, such as current or voltage, at the sense electrode 557. As shown in FIG. 5, the operational amplifier 521 may be configured as an integrator circuit, the output of which provides an output signal Vout that is proportional to the displacement of the beam. An exemplary circuit and method of generating the output signal Vout will now be described in more detail.

As the signal Vdrive increases, for example, from 1V to 2.5V, Vout output from the signal conditioner 520 may decrease from its steady state voltage, for example, from 1V to −8V. In response to the decrease in the signal Vout on the input of the drive circuit 530, operational amplifier 531 outputs a signal Vout2 that decreases from, for example, 1 to −80V. The signal Vout2 is applied to a gate electrode 554 of the MEM device 550, and actuates the MEM device 550. The beam 552 in the MEM device 550 responds to the voltage on the gate electrode 554 by moving downward toward the gate electrode 554. As the beam 552 moves downward, the capacitance Cqs, between the beam 552 and the sense electrode 557, detected by sense electrode 557 increases as does the capacitance Cbeam. The capacitance Cbeam is the capacitance between the beam 552 and the gate electrode 554. The increase of capacitance Cqs at sense electrode 557 causes electrical charge Q to be drawn from capacitor C2 in the signal conditioner 520. The virtual ground in signal conditioner 520, at the circuit node between the capacitor C1 and the inverting input to operational amplifier 521 is maintained at a virtual ground reference voltage, such as 1V, for example. This virtual ground reference voltage is maintained equal to the reference voltage VREF applied to the non-inverting input of operational amplifier 521. As the charge Q is pulled from capacitor C2, Vout increases to maintain the voltage at the virtual ground equal to the reference voltage VREF applied to the non-inverting input of operational amplifier 521.

As the beam 552 is moving downward, the capacitance Cbeam between the beam 552 and the gate electrode 554 is increasing resulting in a reduced voltage across the beam 552 and the gate electrode 554. When the beam 552 lands at a stop (not shown), a constant signal is detected by the sensing electrode 557 and output to the input of the signal conditioner 520. The steady output signal from the sensor electrode 557 allows the virtual ground to settle to Vdrive, and the output of the amplifier 521 is maintained at its steady state value, for example, 1 volt. This will be maintained until Vdrive is removed, so the switch can be actuated. In the case where the MEM device is normally closed, the voltage Vdrive can be set to a value (e.g., 2.5 volts) equal to or greater than a voltage needed to close the gap between the beam 552 and the stop (not shown) to ensure that the switch is closed. The voltage Vdrive would remain static to maintain the normally closed switch.

In other embodiments, such as when the MEM device 550 is configured as a switch or a two-state capacitor, it may be more beneficial to measure the velocity of the beam, and control the MEM device 550 drive voltage based on the velocity of the beam determined from the signal detected by the sensing electrode in the MEM device. As shown in another embodiment illustrated in FIG. 6, the sensor can be configured as a differentiator that reacts to the current output from the sensing electrode.

In more detail, another exemplary system 600 may include a signal conditioner 620, a drive circuit 630, and a MEM device 650. The MEM device 650 may include a first terminal 653, a second terminal 655A, a third terminal 655B, a beam 652, a gate electrode 654 and a sense electrode 657. As illustrated, the MEM device 650 is similar to the cantilever switch with see-saw sense as shown in FIG. 2B. The gate electrode 654 of the MEM device 650 is connected to an output of the drive circuit 630, and the output of the sense electrode is connected to an input of the signal conditioner 620. By actuation of the MEM device 650, a circuit path is formed between the first terminal 653 and the second terminal 655.

The signal conditioner 620 may include an operational amplifier 621 and a resistor Rv 622. The resistor Rv 622 is connected to the operational amplifier 621 to provide negative feedback, i.e., a first terminal of the resistor Rv 622 is connected to the inverting input of the operational amplifier 621 and a second terminal is connected to the output of the operational amplifier 621. Also connected to the inverting input of the operational amplifier 621 is an output from the MEM device 650. An input voltage Vin is applied to the non-inverting input of the operational amplifier 621.

The drive circuit 630 has a pair of inputs, an output and an amplifier. The exemplary drive circuit of FIG. 6 has an operational amplifier 631 with an inverting input and a non-inverting input. The non-inverting input is connected to an output of the signal conditioner 620. Connected to the inverting input of the operational amplifier 631 are a first terminal of resistor R1 and a first terminal of feedback resistor R2. A second terminal of the resistor R1 is connected to ground and a second terminal feedback resistor R2 is connected to the output of the operational amplifier 631. Of course, more or less inputs may be included, for example, to supply power for amplifiers and other circuit components in the drive circuit 630. Exemplary values for resistors R1 and R2 can be approximately 1K ohm and approximately 20K ohm, or any other values that provide a gain suitable for providing a sufficient gate voltage on gate electrode 654. For example, the above resistor values provide a 20× gain, which allows for a common 5V voltage supply to be used as the gate voltage.

A system configured as shown in FIG. 6 can control the operation of the MEM device 650 by detecting a signal, for example, changes in current, output from the MEM device 650 based on the detected velocity of the beam 652. The velocity of the beam 652 is detected as the beam moves closer to sense electrode 657. The signal conditioner 620 and drive circuit 630 act to output a gate voltage that is proportional to the velocity of beam 652. The beam 652 is shown in a see-saw (teeter-totter) configuration having a first terminal 653 at the hinge of the beam 652, a second terminal 655A at a first end (A) of the see-saw, and a third terminal 655B at a second end (B) of the see-saw. With the MEM device 650 in an initial state, a circuit path may be present between the first terminal 653 and either or both of the second terminal 655A or the third terminal 655B.

In more detail, when a drive voltage $V_{gate}$ output from the drive circuit 630 is applied to the gate electrode 654, the first end (A) of the see-saw above the gate electrode 654 is pulled downward by the electrostatic force generated by the gate voltage $V_{gate}$. As first end (A) of the beam 652 moves downward, the gate capacitance $C_{gate}$ increases, and, conversely, second end (B) of beam 652 moves upward, the beam capacitance $C_{beam}$ decreases at the sensor 657. The decrease in capacitance $C_{beam}$ causes a current $I_{sense}$ output to the signal conditioner 620. Due to the high input impedance into the operational amplifier 621, the current $I_{sense}$ passes through resistor Rv 622. The current $I_{sense}$ passing through the resistor Rv 622 causes a voltage $V_{Rv}$ to be present at the inverting input of the operational amplifier 621, and the voltage output from the operational amplifier 621 drops, which reduces the gate drive voltage $V_{gate}$ output from the drive circuit 630 to the MEM device 650. The downward momentum of the beam 652 will continue the movement of the beam 652 to its stop or terminal 655A or terminal 655B.

The sensors 520, 620 implementations of FIGS. 5 and 6, respectively, illustrate that, depending upon the MEM device to be controlled, either the displacement of the beam or the velocity of the beam can be detected. If the displacement of the beam is detected, a voltage signal representative of the displacement can be input to an integrator circuit in the sensing circuitry, and if the velocity of the beam can directly detected, a current signal representative of the velocity is input to a differentiator in the sensing circuitry.

Figure 7:
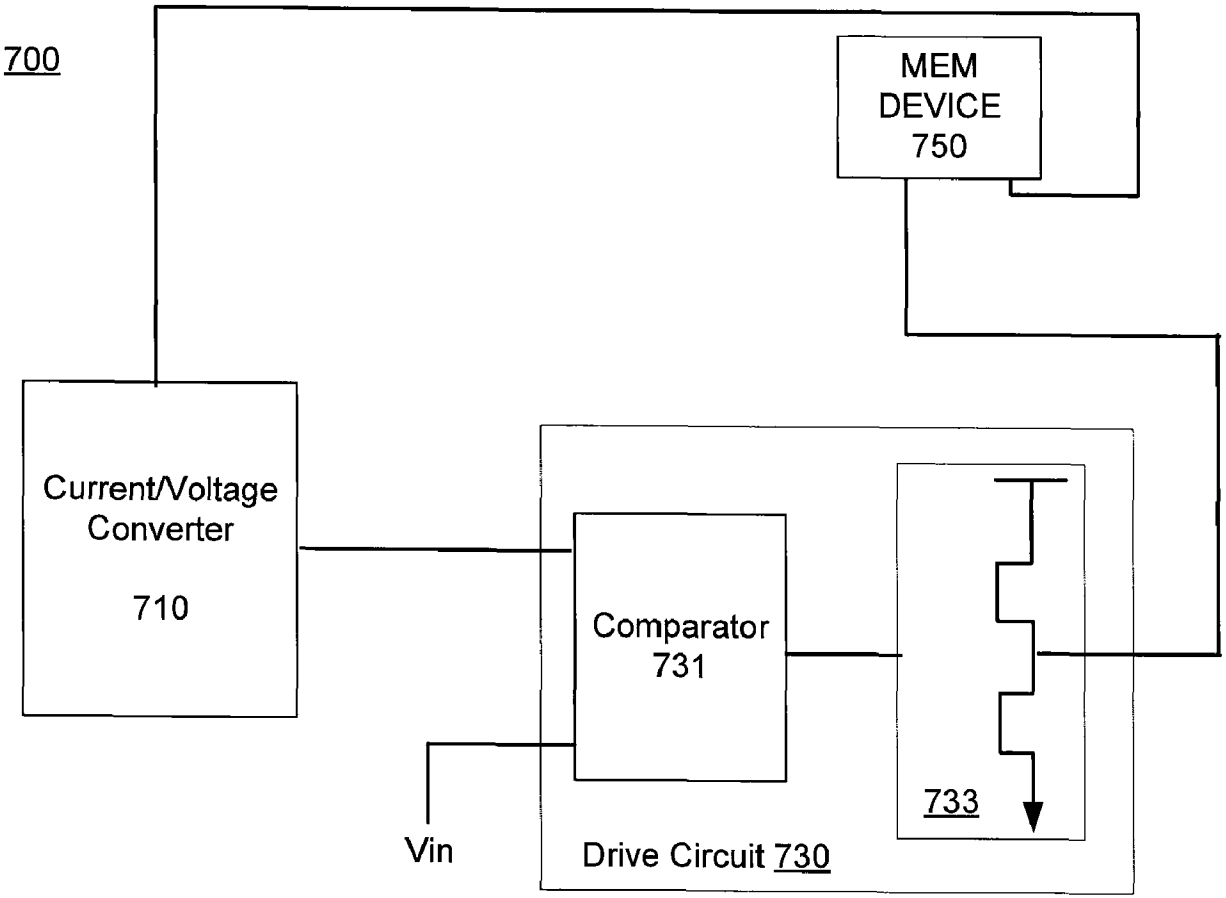
FIG. 7 provides an exemplary implementation of a MEM control circuit according to yet another embodiment of the present invention.

FIG. 7 provides an exemplary implementation of a MEM control circuit according to yet another embodiment of the present invention. The MEM system 700 illustrated in FIG. 7 may include a MEM device 750, a current/voltage converter 720, and a drive circuit 730. The system 700 controls the MEM device 750 by outputting a pulsed signal based on a signal output from the MEM device 750. The current signal output from the MEM device 750 represents the detected velocity of the beam. The MEM device 750 may be any one of the MEM devices illustrated in FIG. 2A, 2B, 2C or 3A. The MEM device 750 outputs the current signal based on the detected velocity or displacement of the beam.

Depending on the type of MEM device 750 in the MEM system 700, the current/voltage converter 720 converts the current signal to a voltage signal or a current signal to a voltage signal. The conversion of the current signal to a voltage may be accomplished in the manner described above in reference to FIG. 6, or any other method that outputs a voltage suitable for application to the drive circuit 730. The voltage signal is output from the current/voltage converter 720 to the drive circuit 730.

The drive circuit 730 may include a comparator 731 and a pulse generator 733. The comparator 731 may have two inputs: a first input received from the current/voltage converter 720 and a second input connected to a reference input voltage Vin. The reference input voltage Vin can be a voltage in the range of approximately 0-1.5 volts. The comparator 731 can output either a high signal (logic 1) or a low signal (logic 0) to the pulse generator 733 based on the result of the comparison of the input signal received from the current/voltage converter 720 and the reference input voltage Vin. If, for example, the output of the comparator 731 is a high signal, or logic 1, the pulse generator 733 can output a drive voltage. A drive voltage may be 80 volts, for example. Alternatively, for example, if the output of the comparator 731 is a low signal, or logic 0, the pulse generator 733 may not output a voltage sufficient to actuate the MEM device 750. Of course, different voltages and pulse logic may be used to drive the MEM device 750.

Figure 8:
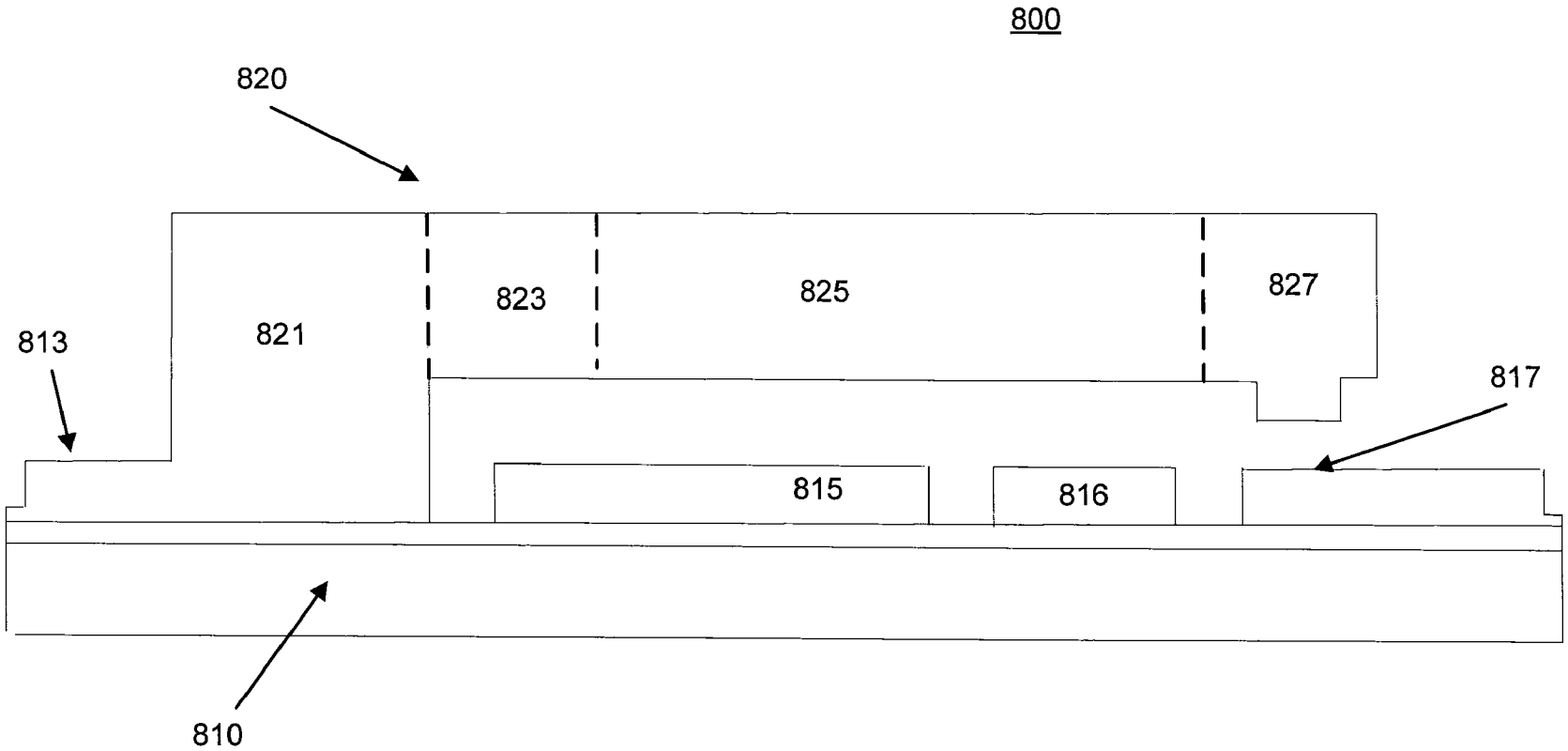
FIG. 8 provides an exemplary cross-sectional view of a MEM device controlled according to an embodiment of the present invention.
Figure 9:
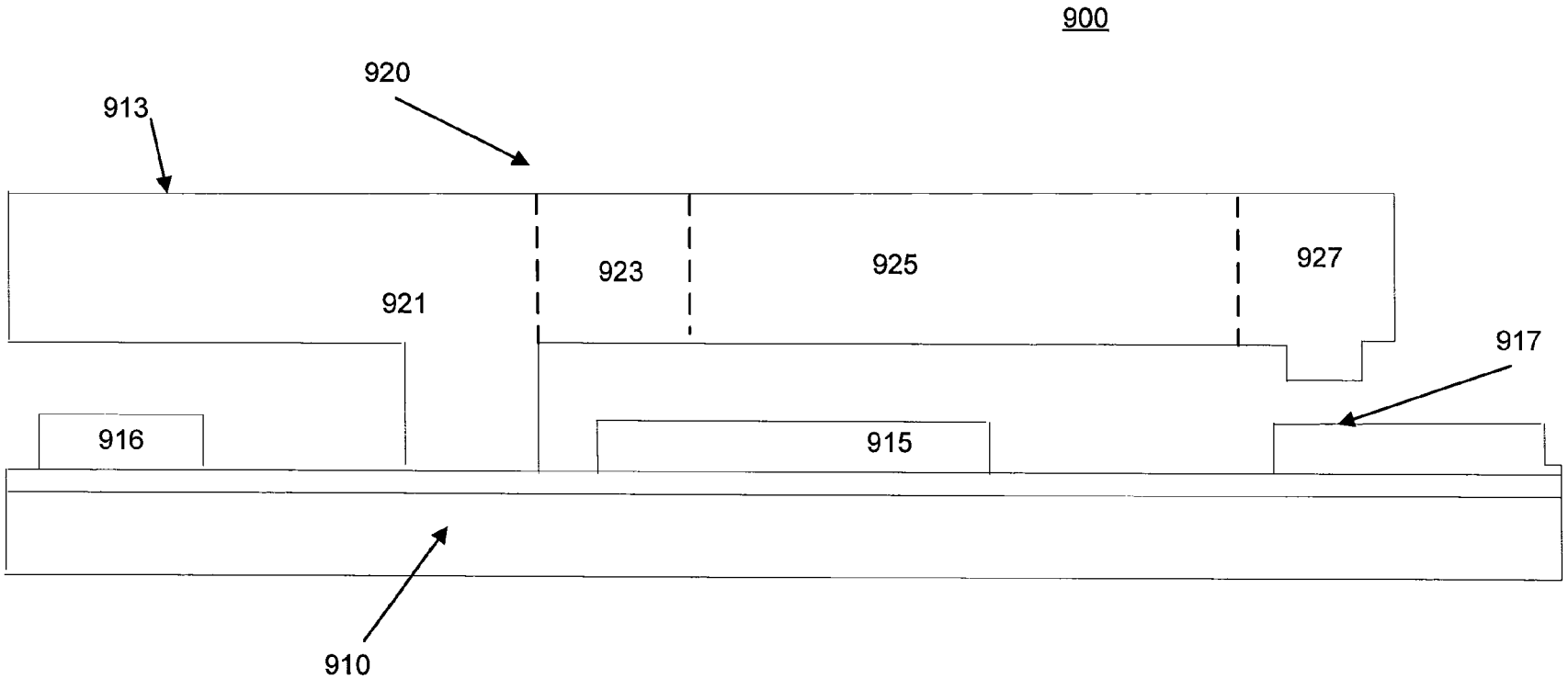
FIG. 9 provides another exemplary cross-sectional view of a MEM device controlled according to an embodiment of the present invention.
Figure 10:
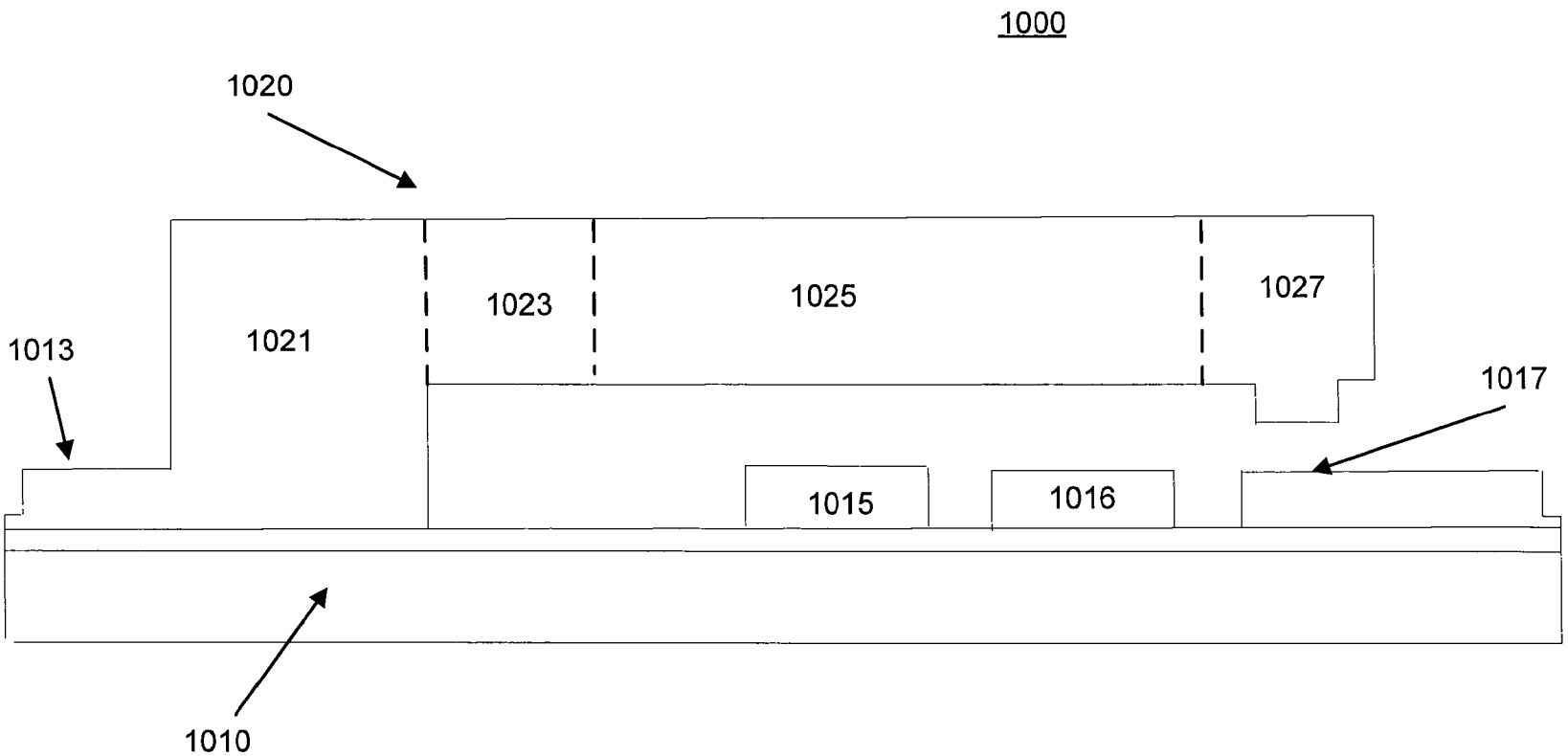
FIG. 10 provides yet another exemplary cross-sectional view of a MEM device controlled according to an embodiment of the present invention.

The above described MEM devices may have a variety of different structures. FIGS. 8, 9 and 10 illustrate exemplary MEM devices.

FIG. 8 provides an exemplary cross-sectional view of a MEM device controllable according to an embodiment of the present invention. The MEM device 800 of FIG. 8 may include a MEM structure 820 and substrate 810. The MEM structure 820 may include an anchor 821, a hinge 823, a beam 825 and a tip 827. The substrate 810 may include a source connection 813, a gate connection 815, a sensor 816 and a drain connection 817. The function and operation of each of the parts of the MEM device 800 is similar to those described with respect to FIGS. 4-7. The sensor 816 may be electrically isolated from the gate connection 815. The locations of gate connection 815 and sensor 816 may be interchanged. However, the sensor 816 may be more sensitive to changes in capacitance the closer the sensor 816 is to drain connection 817.

FIG. 9 provides another exemplary cross-sectional view of a MEM device controlled according to an embodiment of the present invention. The MEM device 900 of FIG. 9 may include a MEM structure 920 and substrate 910. The MEM structure 920 may include an anchor 921, a hinge 923, a beam 925 and a tip 927. The substrate 910 may include a source connection 913, a gate connection 915, a sensor 916 and a drain connection 917. The function and operation of each of the parts of the MEM device 900 is similar to those described with respect to FIGS. 4-7. The sensor 916 may be electrically isolated from the gate connection 915. The locations of gate connection 915 and sensor 816 may be interchanged. However, the sensor 916 is more sensitive to changes in capacitance the closer the sensor 916 is to drain connection 917.

FIG. 10 provides yet another exemplary cross-sectional view of a MEM device controlled according to an embodiment of the present invention. The MEM device 1000 of FIG. 10 comprises a MEM structure 1020 and substrate 1010. The MEM structure 1020 may include an anchor 1021, a hinge 1023, a beam 1025 and a tip 1027. The substrate 1010 may include a source connection 1013, a gate connection 1015, a sensor 1016 and a drain connection 1017. The function and operation of each of the parts of the MEM device 1000 is similar to those described with respect to FIGS. 4-7. The capacitance of variable capacitance 1014 varies according to the distance of the beam 1025 from the variable capacitance 1014. The sensor 1016 may be electrically isolated from the gate connection 1015. The locations of gate connection 1015 and sensor 1016 may be interchanged. However, the sensor 1016 is more sensitive to changes in capacitance the closer the sensor 1016 is to drain connection 1017.

Several features and aspects of the present invention have been illustrated and described in detail with reference to particular embodiments by way of example only, and not by way of limitation. Those of skill in the art will appreciate that alternative implementations and various modifications to the disclosed embodiments are within the scope and contemplation of the present disclosure. Therefore, it is intended that the invention be considered as limited only by the scope of the appended claims.

We claim:

1. A microelectromechanical structure control system, comprising:

a microelectromechanical structure including:

a moveable member coupled to a first electrical terminal, a sensor that outputs a sensor signal representing movement of the moveable member, an actuating electrode, adjacent to the sensor, for receiving a control signal to cause movement of the member;

a second electrical terminal adjacent to the actuating electrode; and a control circuit, responsive to the sensor signal, to adjust a magnitude of the control signal output to the actuating electrode, wherein when the microelectromechanical structure is in a second configuration, the microelectromechanical device operates as a switch to complete a current path from the first electrical terminal through the second electrical terminal, and the actuation of the switch is based on the control signal output by the control circuit.

2. The microelectromechanical structure control system of claim 1, further comprising:

a device terminal connectable to the first electrical terminal; and another device terminal connectable to the second electrical terminal.

3. The microelectromechanical structure control system of claim 1, wherein when the microelectromechanical structure is in a first configuration, the microelectromechanical device provides an impedance between the first electrical terminal and the second electrical terminal, and the magnitude of the impedance is based on the control signal output by the control circuit.

4. The microelectromechanical structure control system of claim 3, wherein the impedance is a capacitance.

5. The microelectromechanical structure control system of claim 1, wherein the microelectromechanical structure is configured with the moveable member located above both the sensor and the actuating electrode.

6. The microelectromechanical structure control system of claim 2, further comprising:

a hinge coupled to the moveable member, wherein a capacitive circuit path is formed between the moveable member and the sensor.

7. A method for controlling a MEM device, comprising:

detecting a movement of a beam structure of a MEM device at a detector on the MEM device;

determining a velocity of the moving beam structure;

outputting a signal based on the detected movement of the beam structure, wherein a magnitude of a current of the outputted signal represents the determined velocity of the moving beam;

using the outputted signal in sensor circuitry to generate a drive signal; and applying the drive signal to a gate electrode of the MEM device.

8. The method of claim 7, further comprising:

determining a displacement of the moving beam structure.

9. The method of claim 8, wherein a magnitude of a voltage of the outputted signal represents the displacement of the beam.

10. The method of claim 7, wherein the MEM device is a switch that creates a current path from a first connection point on the MEM device to a second connection point on the MEM device, and either the displacement or the velocity of the beam is determined from the movement of the beam structure.

11. A system for controlling a MEM device, comprising:

a signal conditioner connected to the MEM device that detects signals output from a sensor of the MEM device, wherein the signals output from the MEM device indicate movement of the MEM device;

a signal processor that processes signals received from the signal conditioner, the signal processor including:

a displacement and velocity processor for determining the displacement of a beam structure in the MEM device, and for determining the velocity of the beam structure in the MEM device based on the signal output by the signal conditioner; and signal processor for processing the signal output from the displacement and velocity processor;

a drive circuit that receives signals from the processor, and converts the received signal to a drive signal that actuates the MEM device; and a controller for controlling the signal processor and indicating to the signal processor which signals are to be output to the drive circuit.

12. The system of claim 11, wherein the signal conditioner comprises a differentiator or an integrator.

13. The system of claim 11, wherein the controller indicates to the processor that the signal output from the MEM device is a displacement signal and indicates that the signal processor is to output a signal indicative of the displacement of a beam of the MEM device.

14. The system of claim 13, further comprising:

an integrator circuit that receives the displacement signal from the MEM device.

15. The system of claim 11, wherein the controller indicates to the processor that the signal output from the MEM device is a velocity signal and indicates that the signal processor is to output a signal indicative of the velocity of the beam of the MEM device.

16. The system of claim 15, further comprising:

a differentiator circuit that receives the velocity signal from the MEM device.

17. A method for controlling a MEM device, comprising:

detecting a movement of a beam structure of a MEM device at a detector on the MEM device;

outputting a signal based on the detected movement of the beam structure;

using the outputted signal in sensor circuitry to generate a drive signal; and applying the drive signal to a gate electrode of the MEM device, wherein the MEM device is a switch that creates a current path from a first connection point on the MEM device to a second connection point on the MEM device, and either the displacement or the velocity of the beam is determined from the movement of the beam structure.

18. A system for controlling a MEM device, comprising:

a signal conditioner connected to the MEM device that detects signals output from a sensor of the MEM device, wherein the signals output from the MEM device indicate movement of the MEM device with respect to an electrical terminal;

a signal processor that processes signals received from the signal conditioner;

a drive circuit that receives signals from the processor, and converts the received signal to a drive signal that actuates the MEM device to complete a current path to the electrical terminal; and a controller for controlling the signal processor and indicating to the signal processor which signals are to be output to the drive circuit, wherein the controller indicates to the signal processor that the signal output from the MEM device is a displacement signal and indicates that the signal processor is to output a signal indicative of the displacement of a beam of the MEM device.

19. A system for controlling a MEM device, comprising:

a signal conditioner connected to the MEM device that detects signals output from a sensor of the MEM device, wherein the signals output from the MEM device indicate movement of the MEM device with respect to an electrical terminal;

a signal processor that processes signals received from the signal conditioner;

a drive circuit that receives signals from the processor, and converts the received signal to a drive signal that actuates the MEM device to complete a current path to the electrical terminal; and a controller for controlling the signal processor and indicating to the signal processor which signals are to be output to the drive circuit, wherein the controller indicates to the processor that the signal output from the MEM device is a velocity signal, and indicates that the signal processor is to output a signal indicative of the velocity of the beam of the MEM device.

20. A method for controlling a MEM device, comprising:

detecting a movement of a beam structure of a MEM device with respect to an electrical terminal at a detector on the MEM device;

determining a displacement of the moving beam structure, wherein a magnitude of a voltage of the outputted signal represents the displacement of the moving beam;

outputting a signal based on the determined displacement of the beam structure;

using the outputted signal in sensor circuitry to generate a drive signal;

applying the drive signal to a gate electrode of the MEM device; and in response to the applied drive signal, completing a current path to the electrical terminal.

* * * * *